United States Patent [19]

Barr et al.

[11] Patent Number: 4,920,333

[45] Date of Patent: Apr. 24, 1990

[54] INTERNAL PILFERAGE ALARM

[75] Inventors: Robert Barr, 1412 Rall Ave., Clovis, 93612; Joel A. Fletcher, San Francisco, Calif.

[73] Assignee: Robert Barr, Clovis, Calif.

[21] Appl. No.: 199,064

[22] Filed: May 26, 1988

[51] Int. Cl.[5] ..... G08B 13/08

[52] U.S. Cl. ..... 340/545; 340/309.15

[58] Field of Search ..... 340/545, 529, 530, 309.15

[56] References Cited

U.S. PATENT DOCUMENTS

| | | | |
|---|---|---|---|
| 3,662,372 | 5/1972 | Levy | 340/545 |
| 4,543,568 | 9/1985 | Hwang | 340/309.15 |
| 4,683,460 | 7/1987 | Nakatsugawa | 340/545 |
| 4,707,684 | 11/1987 | Janke et al. | 340/530 |

*Primary Examiner*—Glen R. Swann, III

*Attorney, Agent, or Firm*—Townsend and Townsend

[57] ABSTRACT

An alarm system for monitoring an entrance/exit from a premises is provided with a deadbolt switch, timing mechanism, alarm circuitry and an alarm indicator. The alarm system is activated when the deadbolt is unlocked. The alarm circuitry determines if the unlocking of the deadbolt was authorized or unauthorized. If the unlocking was unauthorized, the alarm indicator is activated. If the unlocking was authorized, the timing mechanism is activated. If the deadbolt is not relocked within the time period preset into the timing mechanism, the alarm indicator is activated. The timing mechanism may be reset by authorized persons to allow the deadbolt to remain open for additional time periods, one period at a time.

14 Claims, 8 Drawing Sheets

MAIN DC INPUT POWER
(IS-1) -V
(IS-2) +V
MOM. OP- NORM CL BACK-UP CKT. TEST SWITCH
SWITCH S-5
(SO-1)
(SO-2)
(SO-3)
(IND-4) AMBER
"MASTER CLOCK"
(555)
(IT-1)
(IT-2)
+V
R1
R2
C1
C2
"CLOCK PULSE GENERATOR"
(4040)
"TIMING NETWORK"
IT- INPUT TO TIMER (MASTER)
TO- TIMER TO OUTPUT

IS- INPUT SUPPLY
SO- SUPPLY OUTPUT
- IDENTIFIER
(IA-1) (TO-1)
(IA-2) (TO-2)
(IC-1) (TO-3)
(IP-1) (TO-4)
(IE-1) (TO-5)
(IE-2) (TO-6)
IC- INPUT TO CONTROL
CO- CONTROL TO OUTPUT
(EO-12)
(EO-11)
(EO-10)

INTERNAL PILFERAGE ALARM

BACKGROUND OF THE INVENTION

The present invention relates generally to alarm systems, and more particularly to an improved alarm system designed to protect from theft of items stored within a premises.

Alarm systems for doors and other accessways in restaurants, warehouses, and the like, generally fall into two categories. The first category includes those alarms designed to protect from unauthorized entry to the premises. Such alarms may be activated by opening the door or window, by breaking a beam of light, by sensing motion etc.

Alarms of the second category are designed to protect from unauthorized removal of merchandise from the premises. These types of alarms may be similar to those mentioned above. Additionally, this second category includes alarm systems wherein a magnetic or other device is attached to the merchandise and a sensor placed at each exit of the building. When an item is carried past the sensor, an alarm is activated. Authorized removal of the merchandise from the premises is facilitated by deactivation or removal of the magnetic or other device from the merchandise. Only authorized persons are given devices for deactivating or removing the magnetic or other devices from the merchandise.

Certain types of business suffer from "internal pilferage." That is to say, there is a high incidence of theft, by employees, of the goods or products stored or handled by the business. This is an especially serious problem in businesses where there is a significant amount of traffic through the building entrances and exits and where it is difficult if not impossible to monitor the activities of all employees. The problem for some business is compounded when the goods or merchandise cannot be tagged with magnetic or other sensors, and/or when there is a very high turnover of the goods or merchandise.

As an example, consider a restaurant. The restaurant handles many food items in their precooked or preprepared condition. These items must be brought through a service entrance from delivery trucks or the like and stored on the premises for later use. Although service entrances are, as a general rule, locked from the outside, they generally are unlocked from the inside. Unsupervised employees and others having access to the inside of the premises could abscond with the stored food items through the service entrance. These losses represent a real and significant impairment to a restaurant s business. The stolen food items are not on hand when needed. Further, the losses from theft of goods seriously affect the revenue of the restaurant.

What is required in the art, and heretofore unavailable, is an alarm system capable of allowing a select number of people to control traffic through service entrances to a business premises. The alarm must be capable of recognizing authorized versus unauthorized entry or exit from the premises, and sound a Klaxon or otherwise indicate when such entry or exit is unauthorized. Further, the system must be able to accommodate for routine deliveries by allowing the service entrance to remain open long enough for the delivery to be made but not long enough to allow an errant employee to make off with goods from the premises and return unnoticed.

SUMMARY OF THE INVENTION

The present invention provides an alarm system capable of providing a select number of individuals with control over entry and exit from an entrance of a business premises, typically a service entrance. The alarm system is activated whenever a door locking element such as a deadbolt, on the service entrance door is opened without first deactivating the alarm. Deactivation of the alarm is allowed for only a preset length of time. The alarm system includes a key operated switch which starts the deactivation period.

In operation, the system will be installed at loading docks, in restaurants, retail establishments, etc., where goods enter or exit the premises through a door gate or the like. The door or gate will be provided with a sensor switch capable of detecting when the door or gate deadbolt or lock is not in its fully closed position. When such is the case, the alarm will sound, unless deactivated by a key-switch, or similar switch, located in the alarm system. When the key-switch is toggled prior to opening of the deadbolt or lock, a timer mechanism is initiated which deactivates the alarm system for a preset period of time. If the preset period of time expires while the deadbolt or lock remains open, the alarm will sound. The timer mechanism may be reset for subsequent time periods, one time period at a time, by way of the key-switch. etc., so that the door may remain open longer than one individual time period. When the deadbolt or lock is locked, the time period is reset.

DETAILED DESCRIPTION OF THE PREFERRED EMBODIMENT

Figure 1:
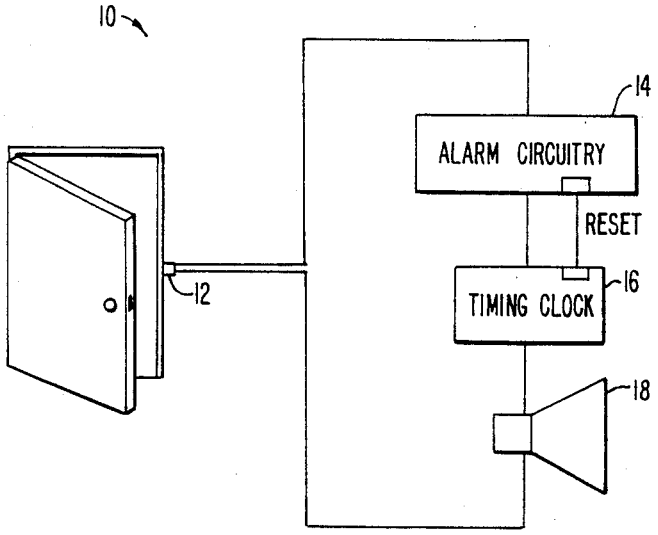
FIG. 1 shows, a typical installation of an alarm system according to the present invention.

FIG. 1 shows a typical installation of an alarm system 10 according to the present invention. The system includes deadbolt switch 12, alarm circuitry 14 timing clock 16, and an alarm indication device 18, such as a speaker, each described in further detail below. This arrangement of the elements of alarm system 10 is such that unauthorized entry to and exit from the premises, and consequently theft of goods from the premises is minimized or eliminated as is more fully disclosed herein.

Figure 2:
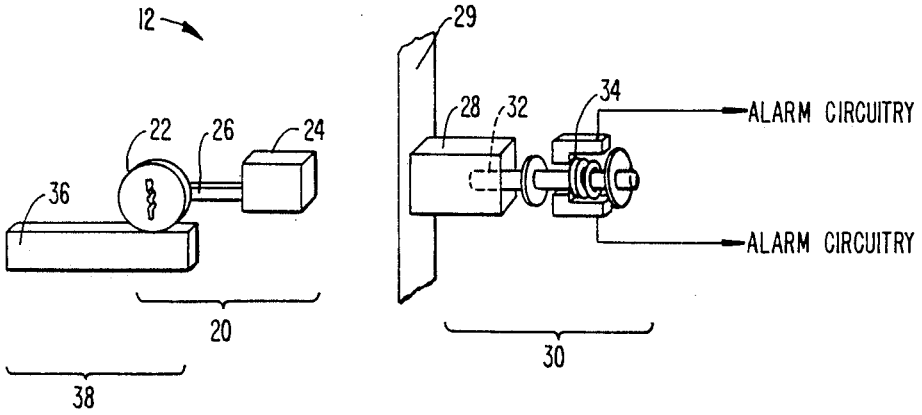
FIG. 2 details a deadbolt switch of typical application in the present invention.

Deadbolt switch 12 is shown in more detail in FIG. 2. There are many switches activated by the closing of a bolt or catch of a door in the art. Switch 12 is one type, shown in detail for completeness, but it is understood that other types of switches may be used without sacrificing the operation of the present invention nor departing from its spirit and scope.

Deadbolt 20 will generally be located within a door structure. Deadbolt 20 will typically include a key-operated lock mechanism 22 which operates a bolt 24 by some sort of linkage 26. Bolt 24, when in the locked position, will generally be disposed in strike 28, which is generally attached to a door jam 29 or the like. When bolt 24 is fully inserted in strike 28 it contacts and depresses switch actuator 32, which breaks (or completes in appropriate circumstances) an electrical circuit. Actuator 32 will be spring-biased by spring 34 so that when bolt 24 is withdrawn from strike 28, actuator 32 completes (or breaks) the circuit.

In certain embodiments it will be desired to connect bolt 24 to a bar 36 of a bar-operated opening system 38 (typically referred to as a "panic bar") such that depressing bar 36 withdraws bolt 24 from strike 28 and such that bolt 24 can only be reinserted by operation of a key-operated lock mechanism 22. Bar 36 will generally be located only on the inside of the premises, so that a key will still be required to unlock the door from the outside.

The use of a bar-operated opening system 38 allows exiting the premises quickly and without the need for a key in the event of an emergency, such as fire, earthquake. etc. In such cases it is not a concern that the alarm will sound when the door is opened, so that opening the door in emergency situations is treated by the alarm system of the present invention in the same way as unauthorized opening of the door. Special means for deactivating the alarm in emergency situations will generally not be provided, although particular applications of the present invention may suggest or require provision of such.

Bar-operated opening system 38 is arranged such that bolt 24 may only be reinserted into strike 28 by means of a key in lock mechanism 22. It is provided that the reinsertion of bolt 24 into strike 28 such that switch actuator 32 will be depressed resets the time clock if reinsertion is within the time period. If, however, the alarm has been activated before bolt 24 is reinserted the alarm may only be deactivated by resetting the time clock by way of a locked reset switch (shown and discussed in detail below). In this way, once the alarm is activated it can only be deactivated by authorized personnel. This method of deactivation of the alarm is in addition to the method of initiating the off-time period of timing clock 16 (FIG. 1) as will be further described below.

Figure 3:
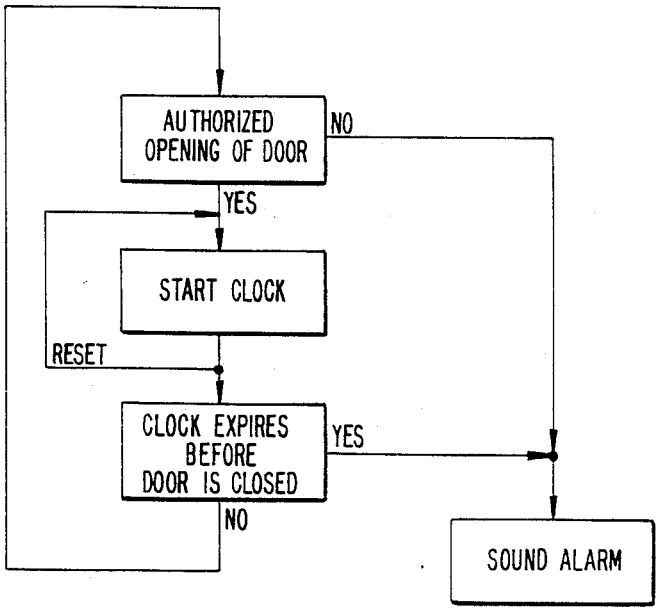
FIG. 3 is a logic flow diagram for the alarm circuitry according to the present invention.

There is a fixed number of "states" that the alarm system according to the present invention may assume. Further, there is a fixed number of paths the alarm system according to the present invention may take from one "state" to the next. FIG. 3 is the logic flow diagram for alarm circuitry 14 showing the possible "states" it may assume and the possible paths it may take between those "states."

Alarm circuitry 14 is capable of determining whether opening of the door is authorized or not. If opening of the door is unauthorized, alarm circuitry 14 will activate alarm 18. The system assumes that unlocking of the deadbolt or lock of the door is equivalent to opening of the door. An "unauthorized" opening of the door is defined as an unlocking of the deadbolt or lock on the door without initiation of the off-time period of timing clock 16 (FIG. 1). Similarly, an "authorized" opening of the door is defined as an unlocking of the deadbolt or lock on the door after first initiating the off-time period of the timing clock 16 (FIG. 1).

If opening of the door is authorized it follows that alarm circuitry will activate timing clock 16. When timing clock 16 is activated, or initiated, a preset clock period, or off-time, begins to run. If the preset clock period expires before the bolt is relocked alarm 18 will be activated.

If the bolt is locked before expiration of the preset clock period, timing clock 16 will be reset and alarm circuitry 14 will be in a state ready to once again determine whether opening of the door is authorized or not. Further, alarm circuitry 14 is capable of allowing timing clock 16 to be reset by authorized persons while the door is opened so that the door may remain open for an additional clock period if needed.

Generally, means for activating the timing clock 16 will be in the interior of the premises. However. many applications of the present invention will find it expedient to locate means for activating timing clock 16 on the outside of the premises as well.

The alarm system according to the present invention may include a device, located at or around the outside of the premises which a vendor, delivery person, employee, etc. may use to request entry to the premises. Speaker 18 or other alarm indication devices may be used, for convenience, as the indication device for the requests for entry. By providing such an entry request device, the device for activating the timing clock may be located exclusively within the premises.

Figure 4:
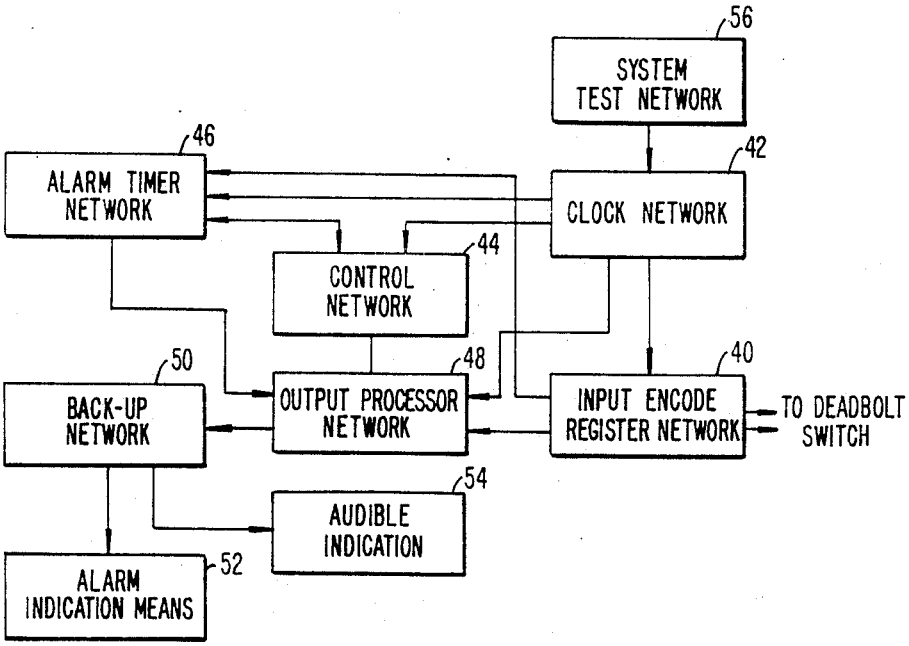
FIG. 4 is a block diagram of the actual alarm circuitry according to the present invention.

FIG. 4 shows a block diagram of the alarm circuitry 14, timing clock 16 and alarm indication device 18. Alarm circuitry 14 according to the present invention comprises a number of alarm modules interconnected in a manner described further below. These modules include input encode register network 40, clock network 42, control network 44, alarm timer network 46, output processor network 48, and back-up network 50. FIG. 4 relates to FIG. 1 in that together clock network 42 and alarm timer network 46 of FIG. 4 comprise timing clock 16 of FIG. 1. The remaining components of FIG. 4 comprise alarm circuitry 14 of FIG. 1. except alarm indication device 52 of FIG. 4, which corresponds to alarm device 18 or other alarm indication means of FIG. 1.

Input encode register network 40 is a logic network driven by clock network 42, capable of determining the status of the deadbolt switch (i.e. whether the bolt is locked or unlocked). Input encode register 40 will output to output processor network 48 a signal indicating that the bolt is unlocked.

Alarm timer network 46 will be polled by control network 44 to determine the status of a timing clock contained in alarm timer network 46 which, when activated, counts down to zero from a preset value (i.e. counts down for the off-time). The timing clock remains at a zero state unless activated to count down, which will be by a key lock. The function of alarm timer network 46 is to deactivate the alarm for the preset period of time but for only that preset period of time.

The polling of alarm timer network 46 by control network 44 will result in generation of a bilevel control signal by control network 44. A first level of the control signal corresponds to a zero state of the timing clock (corresponding to unauthorized opening of the door, or to authorized opening of the door but wherein the off-time has expired) a second level of the control signal corresponds to a non-zero state of the timing clock (corresponding to an authorized opening of the door with the off-time not expired).

The control signal is output by control network 44 to output processor network 48. Output processor network 48 will output to alarm indication means 52 (via back-up network 50, as described below) a signal which will activate alarm indication means 52 (producing an audible alarm, or the like) when the control signal received from control network 44 assumes its first level (indicating a zero state of the timing clock).

In addition to the above, the device for activating the timing clock of alarm timer network 46 allows for extending the authorized opening of the door for a subsequent off-time. The timing clock of alarm timer network 46 is reset in a similar manner to the initial activation of the alarm timer network—toggling a key switch or the like. To allow a user to know whether resetting the timing clock will be required, a digital indication means such as an alpha-numeric LED read-out is provided showing the amount of off-time remaining in the timing clock.

To allow simple repetitive operation of alarm system 10, the timing clock of alarm timer network 46 will automatically reset upon locking of deadbolt 20. Thus, each authorized opening of deadbolt 20 will be provided with a full off-time before activation of the alarm.

An alternate source power source, for example battery power, is provided to power alarm system 10 when main power to the system is interrupted. As well alarm system 10 includes an audible indication device 54 to indicate when main power is interrupted and the alternate power source connected to the system. The alternate power source and audible indication means will be located within back-up network 50.

The audible indication means may be integral with alarm indication means 18 of FIG. 1. In such instances, the indication means may be capable of providing more than one type of indication—providing a first type of indication (e.g. a tone) to indicate unauthorized opening of the bolt or authorized opening of the bolt for longer than the preset period of time, and a second type of indication (e.g., a tone higher or lower than the first) to indicate interruption in the main power source. For this reason, back-up network 50 is placed in-line between output processor network 48 and alarm indication 52.

Figure 5A:
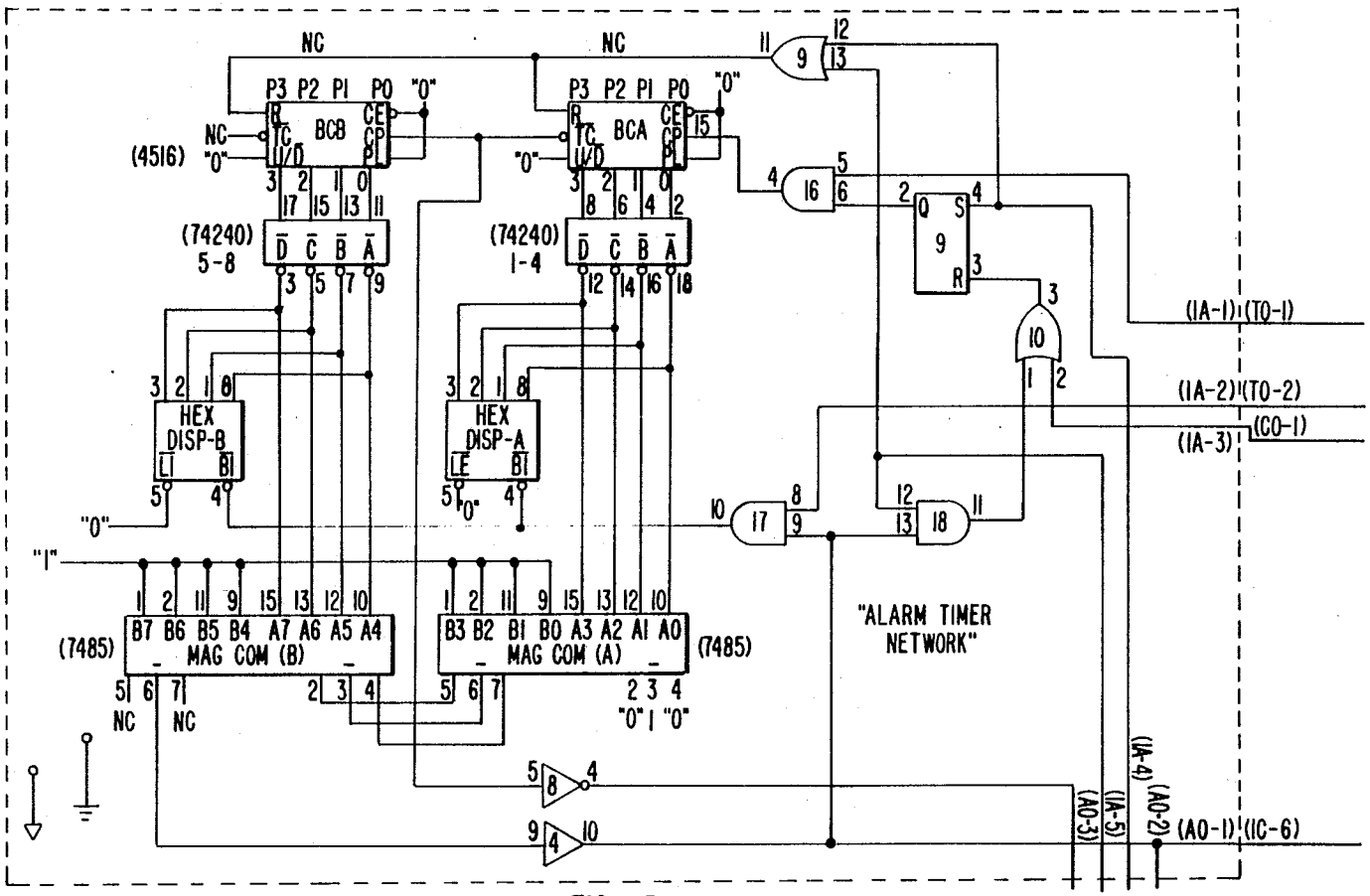
FIG. 5 is a detailed schematic diagram of an alarm circuitry according to a preferred embodiment of the invention.
Figure 5B:
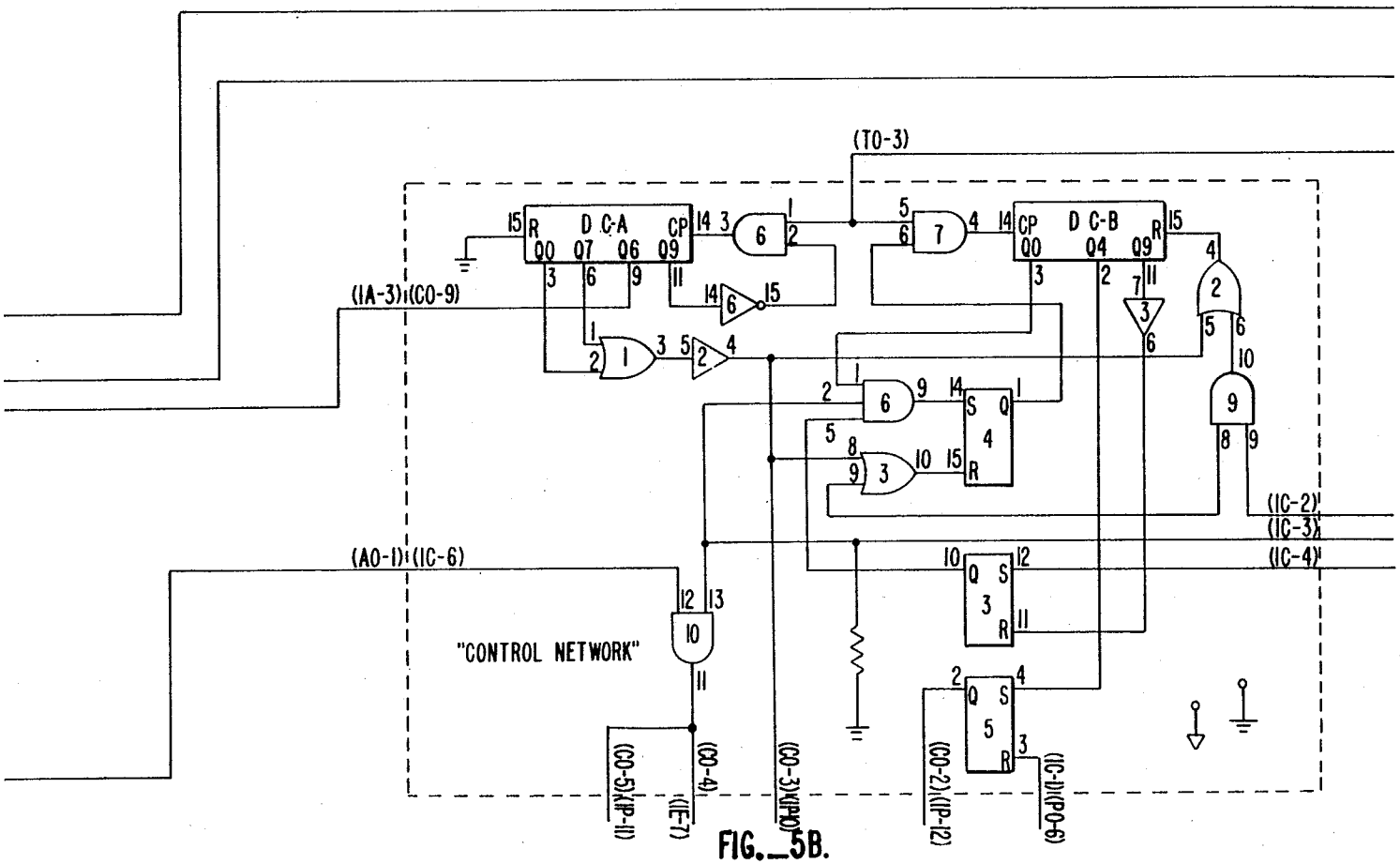
Figures 5, 5A, 5B, 5C, 5D, 5E:
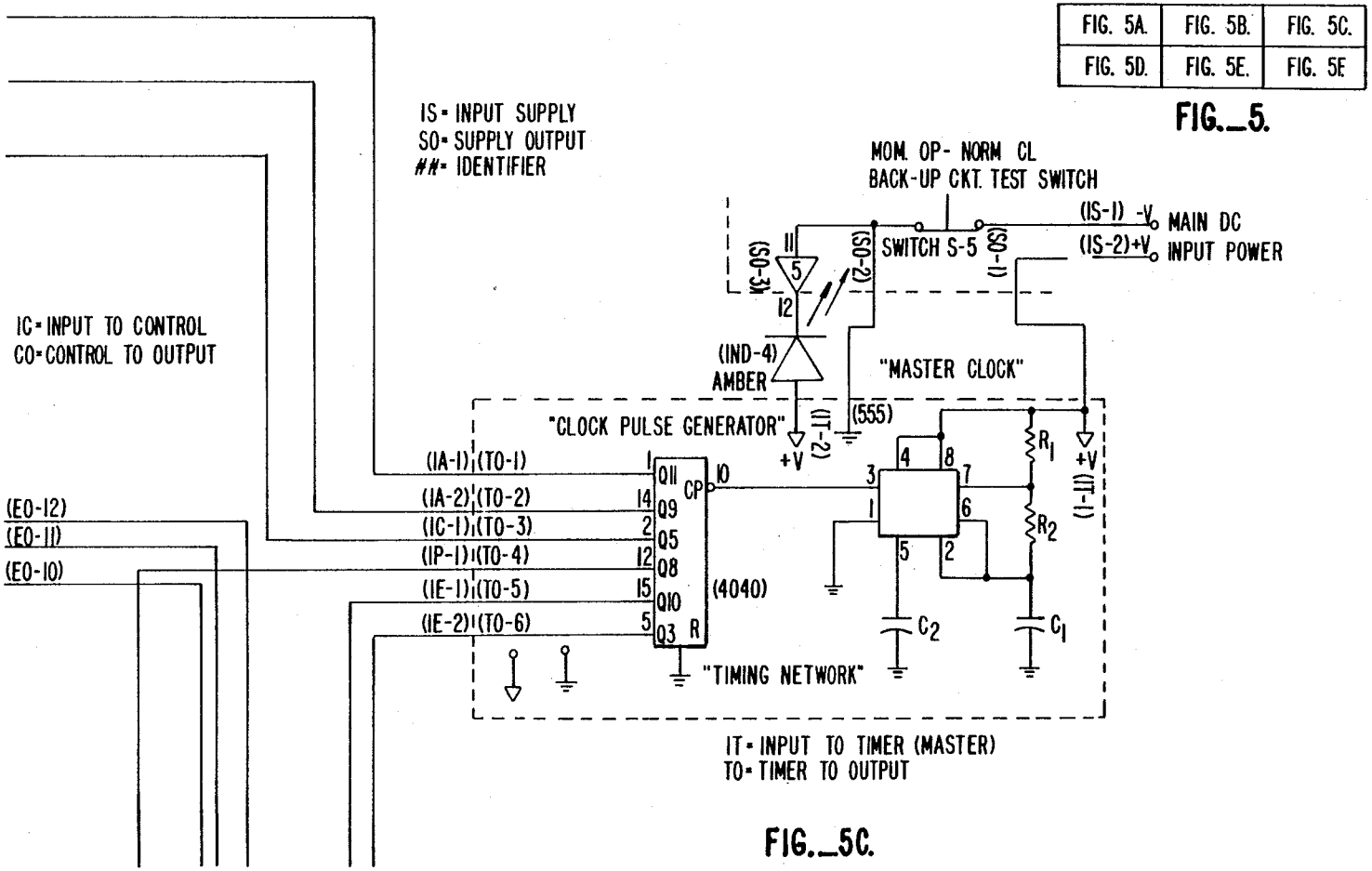
Figure 5D:
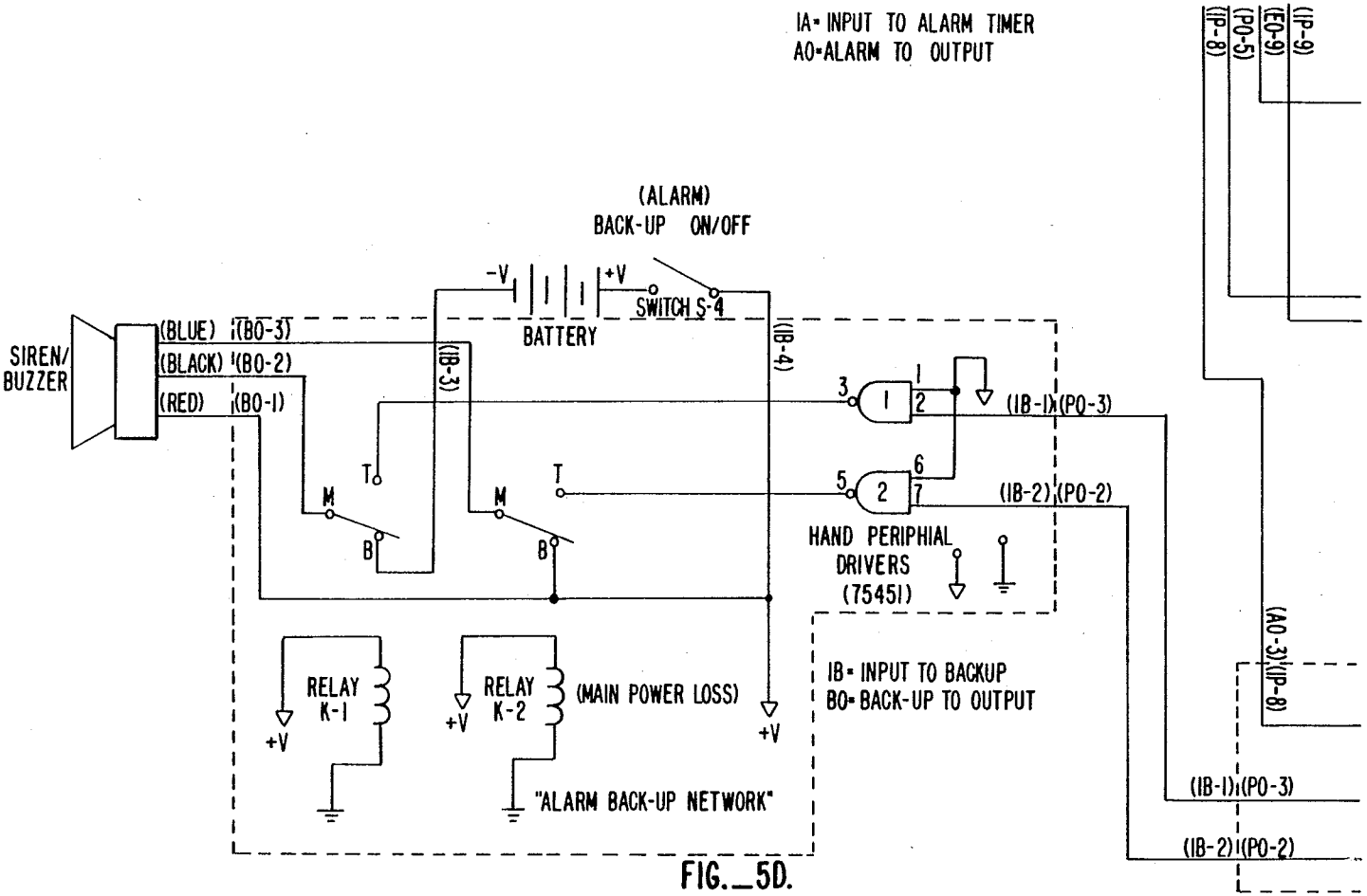
Figure 5E:
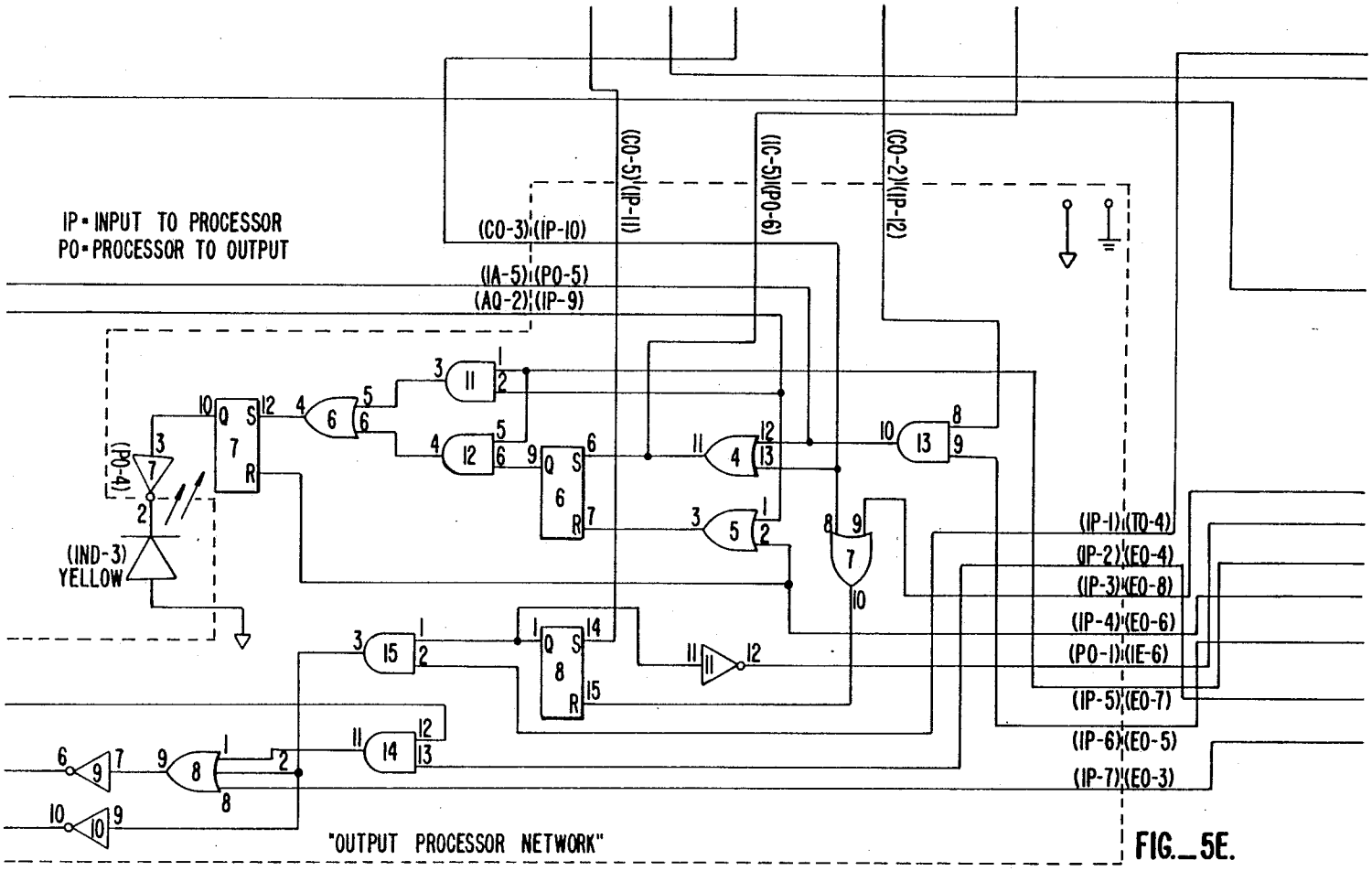
Figure 5F:
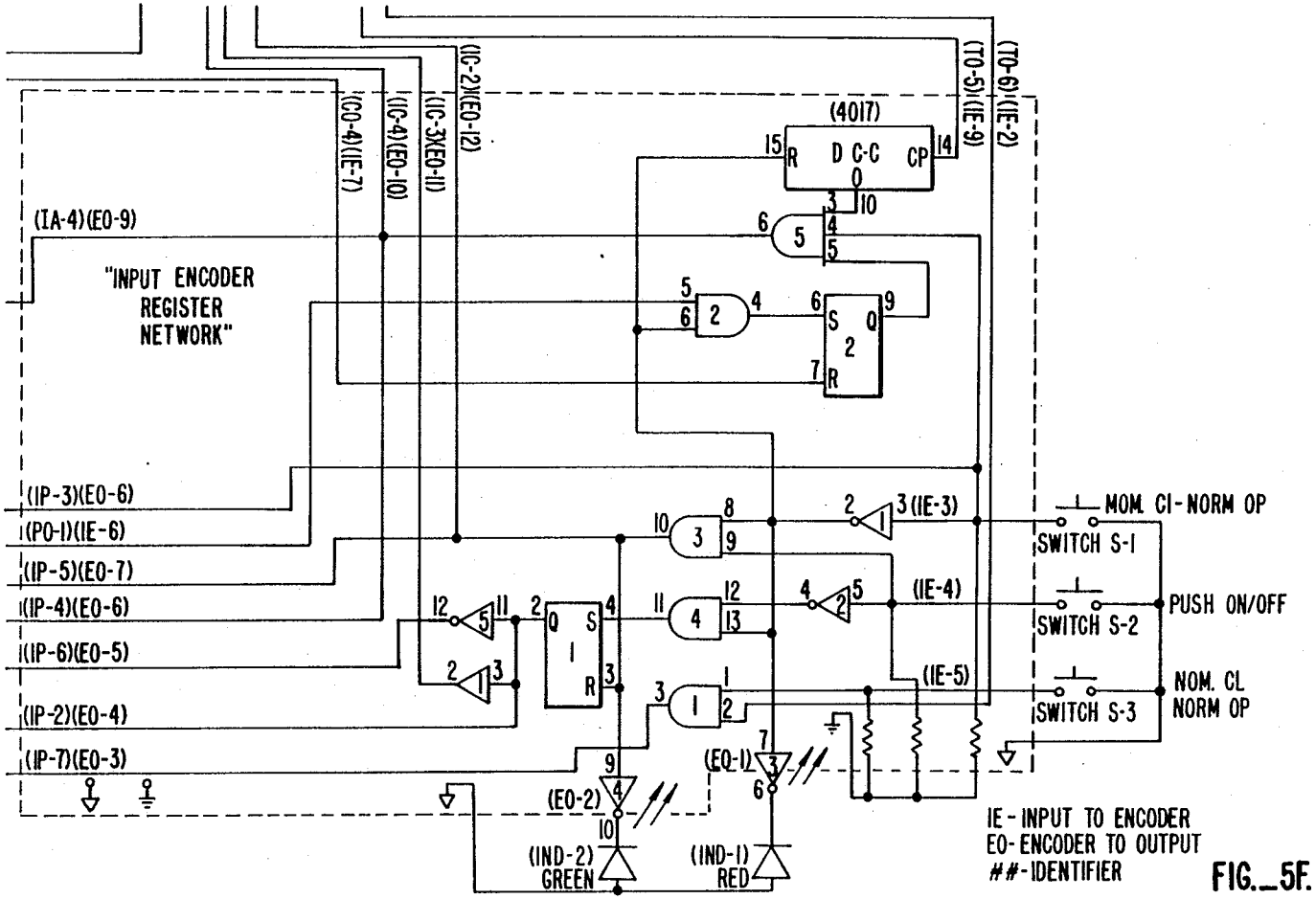

To further aid in a complete understanding of the present invention, a schematic diagram of an alarm circuitry according to a preferred embodiment of the present invention is shown in FIG. 5. FIG. 5 demonstrates one possible arrangement of circuit elements within the teachings of the present invention. Several features discussed above are shown in detail in FIG. 5. For example, system test network 56 of FIG. 4 is shown in the upper right corner of FIG. 5. Other specific examples will be apparent to those skilled in the art. Many others will suggest themselves to those skilled in the art.

In general, to those skilled in the art to which this invention relates, many changes in construction and widely differing embodiments and applications of the present invention will suggest themselves without departing from its spirit and scope. For example, the indication of unauthorized opening of the bolt, or authorized opening of the bolt for longer than the preset period of time has been described in terms of an audible indication. It may, however, be more appropriate in certain applications to indicate the same by activating a light, or outputting to an alpha-numeric display the status of the bolt. Further, any of these indications may be combined with one another in appropriate circumstances.

Likewise, as has been mentioned, many types of switches may serve the function of the deadbolt switch, including electro-mechanical, electrical, optical, acoustical, etc. switches. Thus, the application of the present invention is not limited to doors or gates, but may be utilized with virtually any openable entry/exit without undue modification or experimentation. Thus, the disclosures and descriptions herein are purely illustrative, and are not intended to be in any sense limiting.

What is claimed is:

1. A method of activating an indication device, to indicate the unauthorized opening of a door, which may be temporarily deactivated for only a preset period of time, comprising the steps of determining whether opening of the door is authorized;

activating the indication device if opening of the door is unauthorized;

activating a timing clock set to run for a preselected period of time if opening of the door is authorized, and activating the indication device if the door is not closed within the time period set for the timing clock to run.

2. The method according to claim 1, further comprising the step of resetting the timing clock when the door is closed.

3. The method according to claim 1, further comprising the steps of calculating the time remaining in the time period when the door is open, and displaying the time remaining for viewing.

4. The method according to claim 1, further comprising the step of operating the indication device from a battery back-up system when other sources of power are cut off.

5. The method according to claim 4, further comprising the steps of providing indication that the indication device has switched to battery power or that there is a malfunction of the indication device.

6. The method according to claim 1, further comprising the steps of determining whether the indication device is operating in proper working condition and indicating for observation if the indication device is not in proper working condition.

7. The method according to claim 1, further comprising the step of indicating the presence of a person at the outside of the door who requests entry.

8. An alarm system which indicates the unauthorized opening of a door, which can be deactivated for a only preset period of time, comprising:

an alarm:

means for determining whether opening of a door is authorized;

means for activating the alarm if opening of the door is unauthorized;

a timing clock set to run for a preselected time period;

means for activating the timing clock and starting the time period running if opening of the door is authorized; and means for activating the alarm if the door is not closed before expiration of the time period.

9. The alarm system according to claim 8, wherein the timing clock is reset when the door is closed.

10. The alarm system according to claim 8, further comprising means for indicating time remaining in the time period when the door is open.

11. The alarm system according to claim 8, further comprising a battery back-up system which allows the alarm system to operate when other sources of power are cut off.

12. The alarm system according to claim 11, further comprising first and second indication means, first indication means for indicating that there is an unauthorized opening of the door, second indication means for indicating that the system has switched to battery power or that there is a malfunction of the alarm.

13. The alarm system according to claim 8 further comprising test means for allowing the internal components of the system to be tested for proper working condition.

14. The alarm system according to claim 8, further comprising indicating means for indicating the presence of a person at the outside of the door who requests entry.

* * * * *